US011120778B1

(12) United States Patent
Brieske

(10) Patent No.: US 11,120,778 B1
(45) Date of Patent: Sep. 14, 2021

(54) QUICK RELEASE BASS DRUM BEATER THUMB SCREW

(71) Applicant: Jeremy Brieske, Denver, CO (US)

(72) Inventor: Jeremy Brieske, Denver, CO (US)

(73) Assignee: Low Boy LLC, Denver, CO (US)

( * ) Notice: Subject to any disclaimer, the term of this patent is extended or adjusted under 35 U.S.C. 154(b) by 0 days.

(21) Appl. No.: 17/093,392

(22) Filed: Nov. 9, 2020

Related U.S. Application Data

(60) Provisional application No. 62/933,047, filed on Nov. 8, 2019.

(51) Int. Cl.
*G10D 13/11* (2020.01)

(52) U.S. Cl.
CPC ..... *G10D 13/11* (2020.02)

(58) Field of Classification Search
CPC . G10D 3/01; G10D 3/00; G10D 13/11; G10G 5/005
See application file for complete search history.

(56) References Cited

U.S. PATENT DOCUMENTS

| | | | | |
|---|---|---|---|---|
| 4,198,894 | A | 4/1980 | Della-Porta et al. | |
| 8,063,293 | B1 | 11/2011 | Kjellgren | |
| 2017/0278490 | A1* | 9/2017 | Shigenaga | G10D 13/11 |
| 2020/0043450 | A1* | 2/2020 | Shigenaga | G10D 13/11 |

OTHER PUBLICATIONS

Musician's Friend, "DW Cymbal Tilter Quick Turn Handle", https://www.musiciansfriend.com/accessories/dw-cymbal-tilter-quick-turn-handle/417023000000000, accessed Feb. 18, 2021, 1 page.
Zacuto, "Ratcheting-lever", https://store.zacuto.com/ratcheting-lever/, accessed Feb. 18, 2021, 2 pages.

* cited by examiner

*Primary Examiner* — Kimberly R Lockett
(74) *Attorney, Agent, or Firm* — Schacht Law Office, Inc.; Dwayne Rogge

(57) ABSTRACT

In one example, the disclosed quick release bass drum beater thumb screw comprises a male threaded bolt portion for attachment to a rocker component of a beater assembly. The rocker having a female threaded void therein configured to engage the bolt portion such that rotation of the bolt portion relative to the rocker results in linear/axial movement of the bolt portion relative to the rocker; the bolt portion having a pressure surface on one axial end thereof to frictionally engage an exterior surface of the rotation shaft; the quick release thumb screw comprising a user engagement portion attached to the bolt portion and configured to axially move relative thereto; the user engagement portion comprising a female non-cylindrical surface configured to selectively engage and disengage from the bolt portion to facilitate a ratcheting action; and an elastic member configured to bias the female non-cylindrical surface of the user engagement portion relative to the male non-cylindrical surface on the bolt portion.

8 Claims, 2 Drawing Sheets

QUICK RELEASE BASS DRUM BEATER THUMB SCREW

RELATED APPLICATIONS

This application claims priority of U.S. Provisional Patent Application Ser. No. 62/933,047 filed on Nov. 8, 2019 incorporated herein by reference.

BACKGROUND OF THE DISCLOSURE

Field of the Disclosure

This disclosure relates to adjustment systems for drum beater foot pedal assemblies operated by human feet to rotate beaters to strike drumheads of drums which may be provided in drum sets.

BRIEF SUMMARY OF THE DISCLOSURE

In one example, the disclosed quick release bass drum beater thumb screw comprises several different parts.

In one example, the thumb screw is configured to attach to a bass drum beater which includes a foot pedal movably attached to a pedal frame. The foot pedal frame configured to rest on a floor or equivalent surface such as a lawn, ground, etc. The foot pedal may be coupled to a step force member which is configured to rotate a rotation shaft when the foot pedal is pressed. The rotation shaft attached to the pedal frame and a beater assembly comprising a rocker a beater rod is movably (rotatably) attached to the rocker, and a beater head attached to the beater rod. The rocker is movably attached to the rotation shaft and may be fixed in place by tensioning the quick release thumb screw. A beater rod is movably attached to the rocker, and a beater head is attached to the beater rod. The quick release thumb screw of one example comprising a male threaded bolt portion having male threads thereon for attachment to the rocker. The rocker or other base component having a female threaded void therein configured to engage the male threaded portion of the bolt portion. The female threaded void configured to engage the male threaded portion of the bolt portion of the quick release thumb screw such that rotation of the bolt portion relative to the rocker results in linear/axial movement of the bolt portion relative to the rocker; the bolt portion having a pressure surface on one axial end thereof to frictionally engage an exterior surface of the rotation shaft; the quick release thumb screw comprising a user engagement portion attached to the bolt portion and configured to axially move relative thereto; the user engagement portion comprising a void configured to axially receive a shaft portion of the bolt portion; the void of the user engagement portion comprising a female non-cylindrical surface configured to selectively engage and disengage from a male non-cylindrical surface on the bolt portion; and an elastic member configured to bias the female non-cylindrical surface of the user engagement portion relative to the male non-cylindrical surface on the bolt portion.

The quick release bass drum beater thumb screw may be arranged wherein the rocker is movably attached to move longitudinally along the rotation shaft when the thumb screw is released.

The quick release bass drum beater thumb screw may be arranged wherein the rocker is movably attached to move rotationally about the rotation shaft when the thumb screw is released.

The quick release bass drum beater thumb screw may be arranged wherein the rocker is movably attached to move rotationally about the rotation shaft when the thumb screw is released.

The quick release bass drum beater thumb may be arranged wherein the elastic member is configured to bias the female non-cylindrical surface of the user engagement portion toward the male non-cylindrical surface on the bolt portion.

The quick release bass drum beater thumb screw may be arranged wherein the elastic member is configured to bias the female non-cylindrical surface of the user engagement portion away from the male non-cylindrical surface on the bolt portion.

DETAILED DESCRIPTION OF THE DISCLOSURE

Disclosed herein is a quick release bass drum beater thumb screw 20 with multiple moving parts. The thumb screw 20 of one example particularly well suited for use with a bass drum beater as described below.

Figure 1:
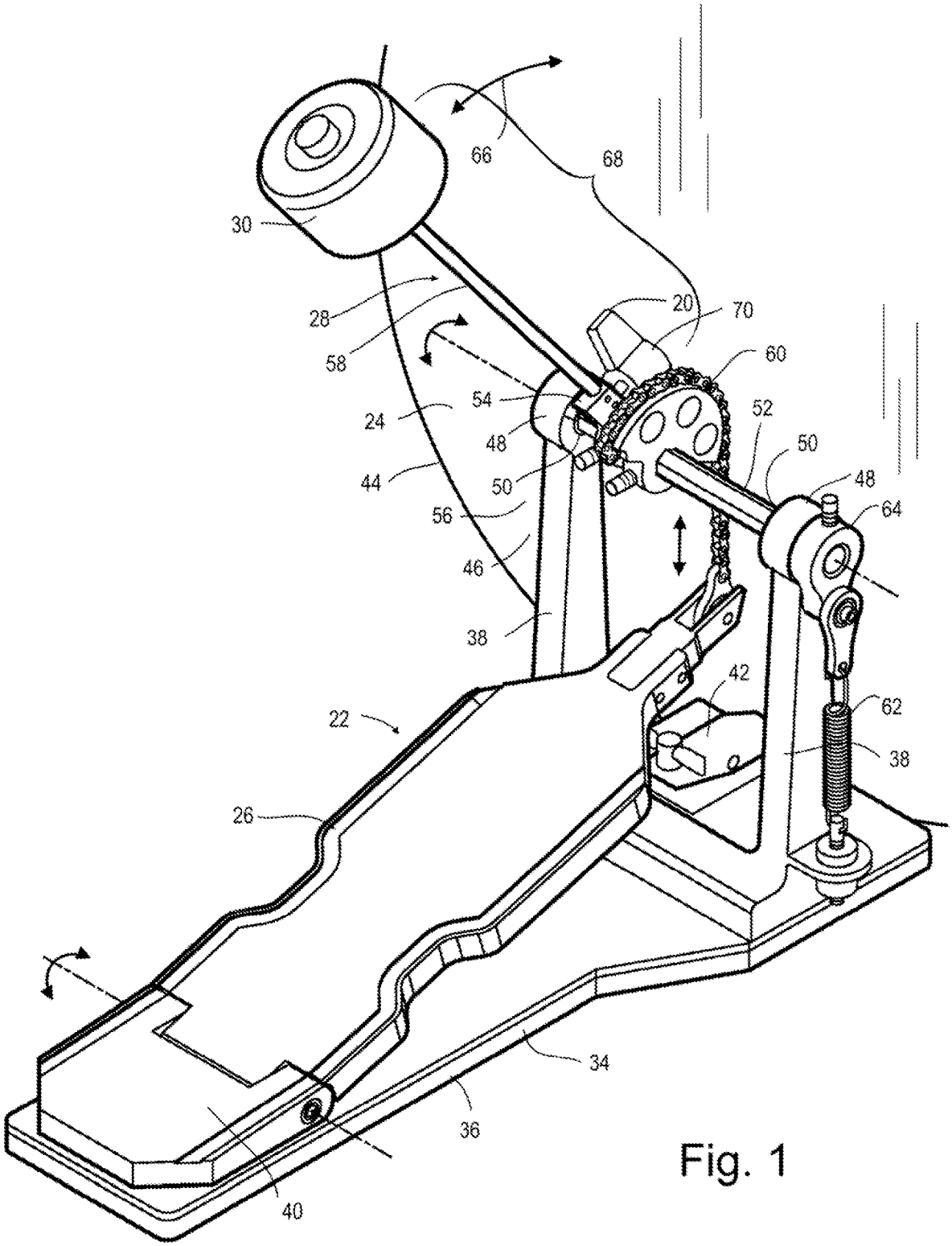
FIG. 1 is an environmental view of one example of the disclosed quick release bass drum beater thumb screw in use on a foot pedal assembly.
Figure 5:
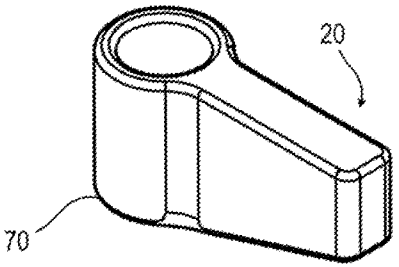
FIG. 5 is a top perspective view of the user engagement portion of the quick release bass drum beater thumb screw shown in FIG. 1.
Figure 6:
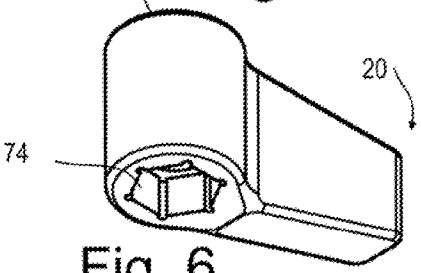
FIG. 6 is a bottom perspective view of the user engagement portion of the quick release bass drum beater thumb screw shown in FIG. 1.

Conventionally, various kinds of foot pedals 22 are proposed and used for drum sets 24 as shown in FIG. 1. Such a foot pedal 22 is designed in such a way that a foot board 26 thereof is depressed by a human foot to rotate a beater assembly 28. A beater head 30 component of the beater assembly 28 strikes a drumhead 32 of a drum. FIG. 1 is a perspective side view illustrating an example of the foot pedal for the drum set conventionally known. Herein, the foot pedal 22 comprises a pedal frame 34. The pedal frame 34 of this example includes a base 36 and support members 38. The support members 38 may be formed as a unitary structure with the base 36. A heel piece 40 is connected to the frame body pedal frame 34 and the foot board 26 is rotatably attached thereto. A clamp 42 provided to securely fix a clamping frame (or drum hoop 44) of the drum 46. Bearing mounts 48 to which bearings 50 are attached or formed at upper end portions of the support members 38. A rotation shaft 52 is rotatably supported by the bearings 50 and thus can rotate relative to the support members 38.

The beater assembly 28 also includes a rocker 54 which is shown attached to a portion of the rotation shaft 52. The beater head 30 configured to strike (or beat) the drumhead 56 of the drum 46 is connected to the rocker 54 by means of a beater rod 58. The beater rod is fixed in place by tightening the bass drum beater thumb screw 20. This operation will be described in more detail.

In common use, a person depresses the foot board 26 with their foot, so that step force is imparted to the foot pedal 22. The step force transfer member 60 transmits movement of the foot board 26 to the rotation shaft 52, and thus rotates the rocker 54 and other components of the beater assembly 28 to drive the beater head 30 to impact the drum head 56. The step force transfer member 60 in one example may be produced from materials having plasticity such as leather, ribbon, cord, string, cables or may for example be produced more rigid components such as an armature, belt, chain as shown, or equivalent.

The foot board 26 is commonly formed as a unitary (single cast) body in a flat-plate shape having an area which is sufficient for a person to engage with the sole of their foot. A front end of the foot board 26 is generally connected to a first end of the step force member 60. A rearward end of the foot board is rotatably connected to the heel piece 40 such that the foot board 26 pivots when presses upon.

To bias the foot board 26 to the position shown in FIG. 1, the rotation shaft 52 is connected to a return spring 62 or other mechanism by means of a cam 64. The return spring 62 biases the foot board 26 upward and the beater assembly 28 rearward away from the drumhead 56. The return spring 62 is generally connected to the pedal frame 34.

When performing a step operation on the foot board 26 of the foot pedal 22 described above, the step force transfer member 60 moves, so that the beater assembly 28 rotates (direction 66) together with the rotation shaft 52. Thus, the beater head 30 strikes the drumhead 56 of the drum 46 producing a sound (vibration). In some examples, a maximum step angle by which the foot board 26 rotatably moves in a downward direction is about 15°. After the beater head 30 strikes the drumhead 56, when step force is released from the foot board 26, the foot board 26 is biased upward by force of the return spring 62. In this way, the foot board 26 is biased to an initial state shown in FIG. 1, ready to be re-cycled for a subsequent strike against the drumhead 56.

Often it is desired to adjust the effective length 68 of the beater rod between the axis of rotation of the rotation shaft 52 and the point of impact on the beater head, where the beater head 30 impacts the drumhead 56. It may also be desired to adjust the rotational position of the beater head, for example where the beater head has a worn area, is not rotationally symmetric, or where the beater head is not rotationally uniform in harness or surface texture. It may also be desired to remove and replace the beater rod 58 and beater head 30 for a different beater rod 58 and beater head 30.

To make such adjustment and replacements easily, and without tools, (where an operator may by hand make these adjustments) the disclosed quick release bass drum beater thumb screw 20 is used.

Figure 7:
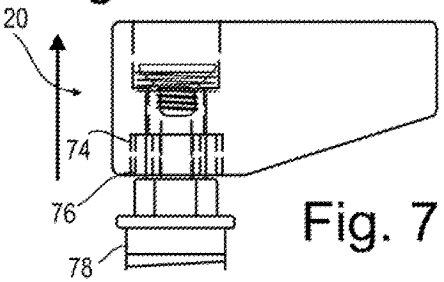
FIG. 7 is a cross-sectional view of the user engagement portion of the quick release bass drum beater thumb screw shown in FIG. 1 in a dis-engaged position.

To operate, a user simply rotates the thumb screw 20 by applying rotational force to the user engagement portion 70, resulting in linear movement of the thumb screw 20 relative to the rotation shaft 52. A pressure surface 72 This thumb screw 20 is effectively a ratcheting thumbscrew, where the user engagement portion 70 repositions relative to the threaded shaft portion to ease in applying force, and to operate in tight confines where a complete rotation may not be possible. In use, the user rotates the connected user engagement portion 70 and bolt portion 78 to tighten or loosen tension between the rocker 54 and the rotation shaft 52 The user may pull the user engagement portion away from the bolt portion (FIG. 7), thus disengaging a non-cylindrical surface 74 of the user engagement portion 70 to a corresponding non-cylindrical surface 76 of a bolt portion 78. When so dis-engaged, the user may rotate the user engagement portion 70 separately from the bolt portion 78. This allows a ratcheting action of the thumb screw 20 for ease of use and use where a full rotation may not be permitted by adjacent components.

In many prior art applications, a bolt such as a square headed tension rod is used for such adjustment or replacement of the beater rod 58 and beater head 30. Such square headed tension rods are well known in the art of drums and use a tool, often a drum key, to operate as their construction does not allow rotation by hand without a tool. There are drawbacks of using a tool such as a drum key to adjust a beater assembly. Using a tool such as a drum key to swap a beater may be quick and easy, except:

Like guitar picks, drums keys tend to disappear with regularity. If a user cannot find their drum key, the user cannot replace nor adjust the beater assembly when needed.

It is not an uncommon occurrence for a beater to loosen in the middle of a song. In that case, the extra few seconds it takes a user to find their key and tighten the set screw is a few seconds too many.

It is conceived to have the disclosed thumb screw 20 provided in several sizes to retrofit bass drum pedals/rockers and other components on the market today. Market testing has shown that several pedal manufacturers use ¼" or M8 thread sizes, with lengths that are substantially uniform, on the order of ¼"+/−½". Thus, a user may simply remove an existing bolt and install the thumb screw 20 in the existing rocker 54 using an existing female threaded void In one example the threaded shaft portion of the thumb screw 20 is produced in several sizes (diameter, thread pitch, length) to fit existing rockers and other components as a retrofit to existing components.

The disclosed ratcheting thumb screw 20 can be used to replace many tension rods or bolts, including:

Bass drum, snare drum, or tom-tom tension rods

Bass drum pedal adjustments, including double bass pedal linkage systems

Hi hat clutch screws

Memory locks

Cymbal stand height adjustment

Bass drum spurs

Figure 8:
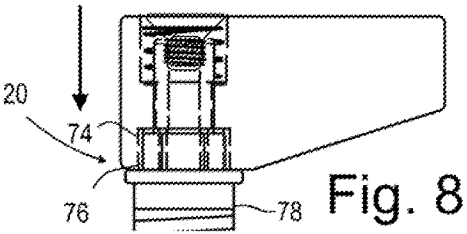
FIG. 8 is a cross-sectional view of the user engagement portion of the quick release bass drum beater thumb screw shown in FIG. 1 in an engaged position.
Figure 4:
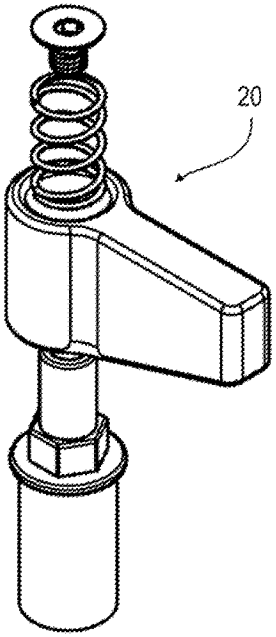
FIG. 4 is an exploded perspective view of the quick release bass drum beater thumb screw shown in FIG. 1.
Figure 2:
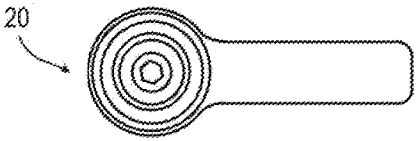
FIG. 2 is a top view of the quick release bass drum beater thumb screw shown in FIG. 1.
Figure 3:
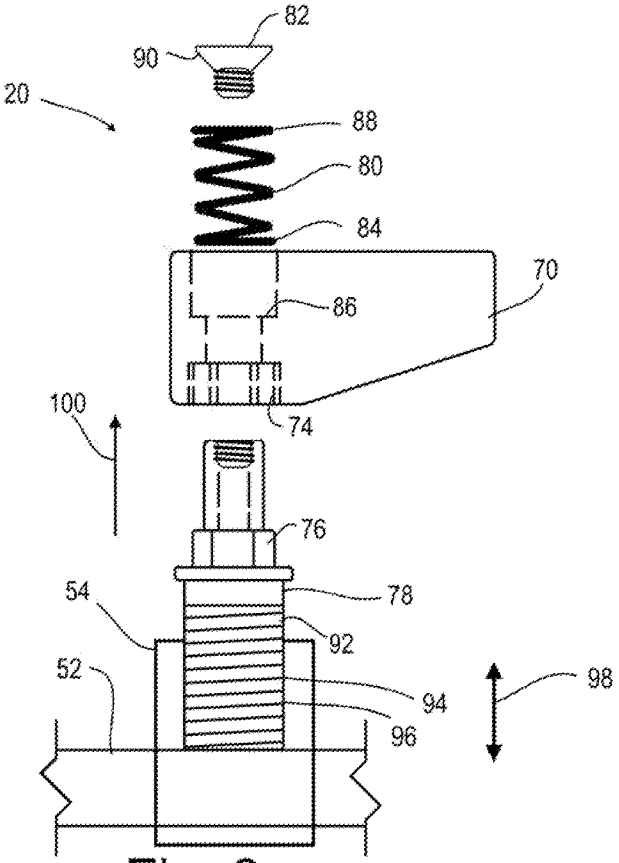
FIG. 3 is an exploded side view of the quick release bass drum beater thumb screw shown in FIG. 1.

Looking to FIG. 3 is shown a side hidden line exploded view of one example of the thumb screw 20 threaded into a highly schematic version of a rocker 54 and a rotation shaft 52. The user engagement portion 70 is shown separated from the bolt portion 78 to more easily view the components thereof. An elastic member, such as for example a compression spring 80 is also shown removed by releasing a spring retaining screw 82. The compression spring 80 has a first end 84 which presses against a surface 86 of the user engagement portion 70, and a second end 88 which in this example presses against a surface 90 of the spring retaining screw 82. The compression spring 80 biases the user engagement portion 70 toward the bolt portion 78 as shown in FIG. 8 such that the non-cylindrical surface 74 of the user engagement portion 70 engages the noncylindrical surface 76 of the bolt portion 78 and force is transferred there between to rotate the thumb screw 20. Where the bolt portion 78 comprises male helical threads 92 configured to engage (thread into) a void 94 having female threads 96 therein configured to cooperate with the threads 92 such that rotation of the bolt portion 78 relative to the rocker 54 results in linear (axial/along the rotational axis of the bolt portion 78 movement 98 relative to the rocker 52.

Thus, a user may rotate the user engagement portion 70 and when the non-cylindrical surface 74 of the user engagement portion 70 is engaged with the non-cylindrical surface 76 of the bolt portion 78, the bolt portion 78 will rotate with the user engagement portion 70 and thus move linearly/helically relative to the rocker 54. However, when a user pulls the user engagement portion 70 in direction 100, against the bias of the compression spring 80, the non-cylindrical surface 74 is dis-engaged from the non-cylindrical surface 74 and rotation of the user engagement portion 70 will not rotate the bolt portion 78. Thus, the thumb screw 20 may be operated in a ratcheting action where the user pulls the user engagement portion 70 in direction 100, against the bias of the compression spring 80 as the user engagement portion is rotated in a first direction, and allows the non-cylindrical surface 74 to engage with the non-cylindrical surface 74 when the user rotates the user engagement portion in a rotational second direction.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A quick release bass drum beater thumb screw comprising:

a foot pedal movably attached to a pedal frame;

the foot pedal frame configured to rest on a floor;

the foot pedal coupled to a step force member configured to rotate a rotation shaft attached to the pedal frame when the foot pedal is pressed;

a beater assembly comprising a rocker with a beater rod movably attached to the rocker, and a beater head attached to the beater rod;

the rocker movably attached to the rotation shaft, a beater rod movably attached to the rocker, and a beater head attached to the beater rod;

a quick release thumb screw comprising a male threaded bolt portion having male threads thereon;

the rocker having a female threaded void therein configured to engage the male threaded portion of the bolt portion;

the female threaded void configured to engage the male threaded portion of the bolt portion such that rotation of the bolt portion relative to the rocker results in linear/axial movement of the bolt portion relative to the rocker;

the bolt portion having a pressure surface on one axial end thereof to frictionally engage an exterior surface of the rotation shaft;

the quick release thumb screw comprising a user engagement portion attached to the bolt portion and configured to axially move relative thereto;

the user engagement portion comprising a void configured to axially receive a shaft portion of the bolt portion;

the void of the user engagement portion comprising a female non-cylindrical surface configured to selectively engage and disengage from a male non-cylindrical surface on the bolt portion; and an elastic member configured to bias the female non-cylindrical surface of the user engagement portion relative to the male non-cylindrical surface on the bolt portion.

2. The quick release bass drum beater thumb screw as recited in claim 1 wherein the rocker is movably attached to move longitudinally along the rotation shaft when the thumb screw is released.

3. The quick release bass drum beater thumb screw as recited in claim 2 wherein the rocker is movably attached to move rotationally about the rotation shaft when the thumb screw is released.

4. The quick release bass drum beater thumb screw as recited in claim 1 wherein the rocker is movably attached to move rotationally about the rotation shaft when the thumb screw is released.

5. The quick release bass drum beater thumb screw as recited in claim 1 wherein the elastic member is configured to bias the female non-cylindrical surface of the user engagement portion toward the male non-cylindrical surface on the bolt portion.

6. The quick release bass drum beater thumb screw as recited in claim 1 wherein the elastic member is configured to bias the female non-cylindrical surface of the user engagement portion away from the male non-cylindrical surface on the bolt portion.

7. A quick release thumb screw comprising:

a quick release thumb screw comprising a male threaded bolt portion having male threads thereon;

a base component having a female threaded void therein configured to engage the male threaded portion of the bolt portion;

the female threaded void configured to engage the male threaded portion of the bolt portion such that rotation of the bolt portion relative to the rocker results in linear/axial movement of the bolt portion relative to the rocker;

the bolt portion having a pressure surface on one axial end thereof to frictionally engage an exterior surface of the rotation shaft;

the quick release thumb screw comprising a user engagement portion attached to the bolt portion and configured to axially move relative thereto;

the user engagement portion comprising a void configured to axially receive a shaft portion of the bolt portion;

the void of the user engagement portion comprising a female non-cylindrical surface configured to selectively engage and disengage from a male non-cylindrical surface on the bolt portion; and an elastic member configured to bias the female non-cylindrical surface of the user engagement portion relative to the male non-cylindrical surface on the bolt portion.

8. The quick release thumb screw as recited in claim 7 configured to be attached to a bass drum foot pedal comprising:

the foot pedal movably attached to a pedal frame;

the foot pedal frame configured to rest on a floor;

the foot pedal coupled to a step force member configured to rotate a rotation shaft attached to the pedal frame when the foot pedal is pressed;

a beater assembly comprising a rocker a beater rod movably attached to the base component, and a beater head attached to the beater rod; and the base component movably attached to the rotation shaft, a beater rod movably attached to the rocker, and a beater head attached to the beater rod.

* * * * *